United States Patent [19]

Bertsch et al.

[11] Patent Number: 4,660,524

[45] Date of Patent: Apr. 28, 1987

[54] FUEL SUPPLY LINE

[75] Inventors: Richard Bertsch, Asperg; Dieter Günther, Murr; Heinrich Knapp, Leonberg; Gunther Plapp, Filderstadtl, all of Fed. Rep. of Germany

[73] Assignee: Robert Bosch GmbH, Stuttgart, Fed. Rep. of Germany

[21] Appl. No.: 712,052

[22] Filed: Mar. 15, 1985

[30] Foreign Application Priority Data

May 10, 1984 [DE] Fed. Rep. of Germany ..... 3417306
Sep. 6, 1984 [DE] Fed. Rep. of Germany ..... 3432727

[51] Int. Cl.[4] ..... F02M 30/00

[52] U.S. Cl. ..... 123/468; 138/28; 138/30

[58] Field of Search ..... 123/468, 469, 470, 472; 138/28, 27, 26, 30

[56] References Cited

U.S. PATENT DOCUMENTS

| | | | |
|---|---|---|---|
| 312,301 | 2/1885 | Starr | 138/28 |
| 830,175 | 9/1906 | Robinson | 138/28 |
| 1,059,370 | 4/1913 | Johnson | 138/28 |
| 2,779,353 | 1/1957 | Coffey | 138/26 |
| 3,929,109 | 12/1975 | Chamberlain | 123/468 |
| 4,205,637 | 6/1980 | Ito | 138/30 |
| 4,295,452 | 10/1981 | Lembke | 123/469 |
| 4,457,280 | 7/1984 | Hudson | 123/468 |
| 4,474,759 | 10/1984 | Katnik | 123/468 |
| 4,494,160 | 10/1984 | Gartner | 123/468 |

*Primary Examiner*—Carl Stuart Miller
*Attorney, Agent, or Firm*—Edwin E. Greigg

[57] ABSTRACT

A fuel supply line for use with fuel injection devices of internal combustion engines is proposed, having supports to contain fuel injection valves. The fuel supply line has an elastic wall section, with which is connected a rigid wall section and on which are fastened the supports. The elastic wall section is elastic to the extent that it damps the pressure pulsations of the fuel in the fuel supply line, whereas the rigid wall section assures the required rigidity of the fuel supply line.

8 Claims, 4 Drawing Figures

FUEL SUPPLY LINE

BACKGROUND OF THE INVENTION

The invention is directed to fuel supply lines as described hereinafter. Fuel supply are known, the walls of which are rigid and in which pressure dampers having elastic membranes are disposed in order to damp the pulsations of the fuel caused by the fuel supply pump and the intermittent action of the injection valves, as well as to avoid the transfer of annoying sounds to the vehicle body. To install a pressure damper in the fuel supply line does not only entail additional installation steps and causes space problems, but it also means additional costs.

OBJECT AND SUMMARY OF THE INVENTION

In contrast to the foregoing, the fuel supply line according to the invention has the advantage of preventing the pressure pulsations occuring in such fuel supply lines and the noises generated thereby without the need for additional steps.

It is especially advantageous to form the fuel supply line with an elastic wall section and a rigid wall section connected with it, on which the supports are disposed. This, given a sufficient rigidity of the entire fuel supply line, insures that the pressure pulsations which occur are damped by the elastic wall section and thereby noises are avoided. Because of space problems and for operational reasons a flat rectangular or triangular diameter of the fuel supply lines is found to be most advantageous.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
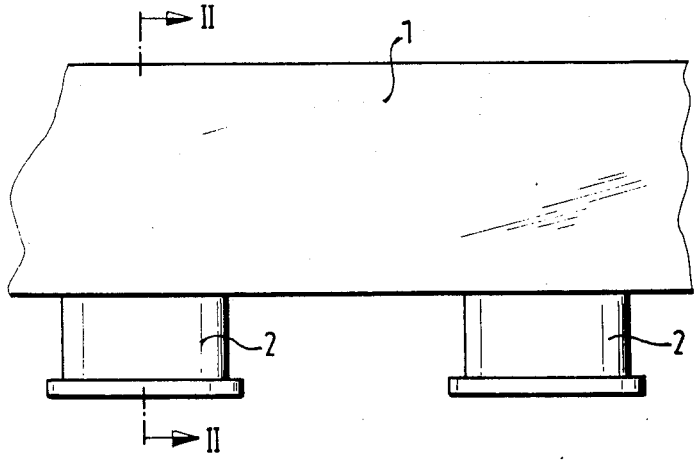
FIG. 1 shows a partial view of a fuel supply line in a longitudinal direction.

FIG. 1 partially shows a fuel supply line 1 in a longitudinal direction having supports 2, each of which are arranged to enshroud a fuel injection valve. The fuel injection valves, not shown, can be inserted into the supports 2 and fastened with clamps, also not shown.

Figure 2:
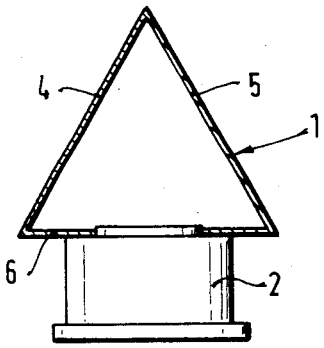
FIG. 2 is a cross sectional view of the fuel supply line along the line II—II.

FIG. 2 shows a cross section through the fuel supply line 1 in accordance with the present invention where the line is formed with a triangular diameter. In this device one of its wall sections 4, 5, 6 being least elastic enough, i.e., having thin walls, will damp the pressure pulsations of the fuel flowing through the fuel supply line 1. These pressure pulsations are known to be caused by the fuel supply pump, and, accordingly, this concept eliminates the creation of all noise from this source. The wall sections 4, 5, 6 can all be made elastic and comprise for instance, sheet metal with a thickness of approximately 0.5 mm. Where the wall sections 4, 5, 6 meet, they can be connected by crimping or by means of welding or soldering. Such a fuel supply line could, of course, also be formed by a continuous extrusion process.

Figure 3:
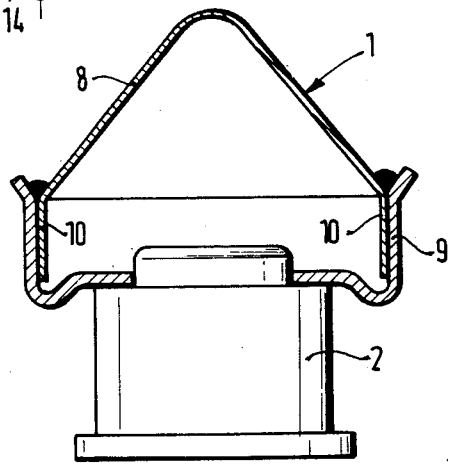
FIG. 3 is a further exemplary embodiment of a fuel supply line according to the present invention in cross section.

In a further exemplary embodiment of a fuel supply line 1 in accordance with FIG. 3, the fuel supply line is formed by an elastic wall section 8, which is triangular, and a rigid wall section 9 which can have a rectangular or trough-like shape. The elastic wall section 8 has been made with such a thin wall that pressure pulsations are damped by it being deformed. The elastic wall section has support walls 10 extending into the rigid wall section 9, and thereafter can be welded or soldered to it, for instance. The rigid wall section 9 on which the supports 2 are disposed has a wall thickness sufficient to assure the necessary rigidity of the fuel supply line.

Figure 4:
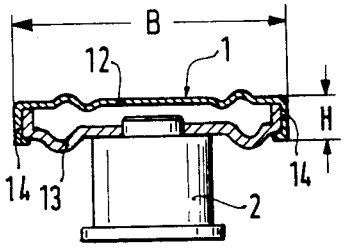
FIG. 4 is an exemplary embodiment of a fuel supply line in accordance with the present invention with a rectangular cross section.

In the exemplary embodiment of a fuel supply line 1 in accordance with FIG. 4, the fuel supply line is formed by a rectangular elastic wall section 12 and a rectangular or trough-like rigid wall section 13. The elastic wall section 12 has such thin walls that the deformation thereof damps pressure pulsations. Additionally the support walls 14, for instance, which partially surround the rigid wall section 13, are connected thereto by soldering, welding or crimping. The rigid wall section 13, on which the supports 2 are disposed, has a wall thickness sufficient to assure the required rigidity of the fuel supply line. In cramped circumstances, particularly under the hood of an automative engine, a flat construction of the fuel supply line 1 is of considerable advantage, wherein the width B across the longitudinal direction is at least three times the height H.

The elastic wall section 8, 12 and the rigid wall section 13 are open at their ends facing each other and together surround the flow cross section of the fuel line 1.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. In a fuel supply of a fuel injection device for internal combustion engines having support means for fuel injection valves, the improvement comprising said fuel supply line having at least one thinly-walled section which is formed of an elastic material so pliable that pressure pulsations of the fuel in said fuel supply line are damped, said fuel supply line further having an elastic wall section arranged to extend in a longitudinal direction and a further rigid wall section connected therewith, said support means for said fuel injection valves being fastened to said rigid wall section, said elastic wall section and said rigid wall section forming a rectangle, and said fuel supply line further has a longitudinal direction, a predetermined width, and a height, said width being at least three times said height.

2. In a fuel supply line of a fuel injection device for internal combustion engines having support means for fuel injection valves, the improvement comprising said fuel supply line having at least one thinly-walled section which is formed of an elastic material so pliable that pressure pulsations of the fuel in said fuel supply line are damped, said fuel supply line further having an elastic wall section arranged to extend in a longitudinal direction and a further rigid wall section connected therewith, said support means for said fuel injection valves being fastened to said rigid wall section, said elastic wall section and said rigid wall section forming a rectangle, and said elastic wall section has portions which partially surround said rigid wall section.

3. In a fuel supply line of a fuel injection device for internal combustion engines having support means for fuel injection valves, the improvement comprising said fuel supply line having at least one thinly-walled section which is formed of an elastic material so pliable that pressure pulsations of the fuel in said fuel supply line are damped, said fuel supply line further having an elastic wall section arranged to extend in a longitudinal direction and a further rigid wall section connected therewith, said support means for said fuel injection valves being fastened to said rigid wall section and said elastic wall section has a triangular shape in cross-section and said rigid wall section has a rectangularly shaped portion.

4. A fuel supply line of a fuel injection device for internal combustion engines having support mean for fuel injection valves wherein said fuel supply line has at least one thinly-walled traingular section formed of a resilient metallic material, the resiliency of said material allowing pressure pulsations occurring in the fuel in said fuel supply line to be damped.

5. A fuel supply line of a fuel injection device for internal combustion engines having support means for fuel injection valves wherein a cross-section normal to the longitudinl axis of said fuel supply line including two distinct metallic walls, at least one of which is formed of a resilient material so pliable that pressure pulsations occurring in the fuel in said fuel supply line are damped.

6. A fuel supply line in accordance with claim 5, further wherein said at least one resilient wall is arranged to extend in a longitudinal direction and a further rigid wall section is connected therewith, and said support means for said fuel injection valves associated with said rigid wall section are fastened thereto.

7. A fuel supply line in accordance with claim 6, further wherein said resilient wall section and said rigid wall section comprise a rectangle.

8. A fuel supply line in accordance with claim 3, further wherein said elastic wall section is provided with support walls which extend into said rectangularly shaped portion.

* * * * *